US005587759A

United States Patent [19]

Kurata

[11] Patent Number: 5,587,759

[45] Date of Patent: Dec. 24, 1996

[54] AUTOMATIC DEVELOPING APPARATUS FOR SILVER HALIDE PHOTOSENSITIVE MATERIALS

[75] Inventor: Noriaki Kurata, Hino, Japan

[73] Assignee: Konica Corporation, Tokyo, Japan

[21] Appl. No.: 423,297

[22] Filed: Apr. 17, 1995

[30] Foreign Application Priority Data

Apr. 30, 1994 [JP] Japan ..... 6-114285

[51] Int. Cl.[6] ..... G03D 3/02

[52] U.S. Cl. ..... 396/630; 221/197; 396/626

[58] Field of Search ..... 354/322–324, 354/331, 336; 430/30, 398–400, 450, 465, 493

[56] References Cited

U.S. PATENT DOCUMENTS 5,318,061 6/1994 Saito ..... 354/324 X
5,400,105 3/1995 Koboshi et al. ..... 354/324
5,480,768 1/1996 Ishida et al. ..... 430/399
5,508,777 4/1996 Isokawa et al. ..... 354/324

FOREIGN PATENT DOCUMENTS

0537365A1 4/1993 European Pat. Off. .

*Primary Examiner*—D. Rutledge
*Attorney, Agent, or Firm*—Frishauf, Holtz, Goodman, Langer & Chick, P.C.

[57] ABSTRACT

In an apparatus for processing a silver halide photographic material with a processing solution, a processing agent supply section is movable between a first position and a second position. On the first position, the supply section is brought in connection with a dissolving section in which the agent is dissolved, and on the second position, the supply section is disconnected from the dissolving section. The supply section includes an accommodation member in which the agent is stored, and a supply member to supply the agent into the dissolving section on the second position.

16 Claims, 14 Drawing Sheets

AUTOMATIC DEVELOPING APPARATUS FOR SILVER HALIDE PHOTOSENSITIVE MATERIALS

BACKGROUND OF THE INVENTION

The present invention relates to a compact automatic developing apparatus for silver halide photosensitive materials of easy operation, further the chemicals used in the developing apparatus are stabilized so that the frequency of replenishment is reduced.

Silver halide photosensitive materials, which will be referred to as photosensitive materials or photographic materials hereinafter, are exposed to light and then subjected to the processes of development, desilverization, cleaning and stabilization. In the developing process, a monochromatic or color developing agent is used. In the desilvering process, a bleaching agent, bleaching and fixing agent or fixing agent is used. In the cleaning process, city water or ion exchange water is used. In the stabilizing process, a stabilization solution is used. A solution having the function of processing in each process is defined as a processing solution. Temperature of each processing solution is commonly maintained in a range from 30° to 40° C., and photosensitive materials are dipped in the processing solution so as to be processed.

In a common automatic developing apparatus for silver halide photosensitive materials, which will be referred to as an automatic developing apparatus hereinafter, the above processing is carried out when the silver halide photosensitive materials are conveyed into the processing tanks in which the above processing solutions are accommodated. In general, the automatic developing apparatus for silver halide photosensitive materials is defined as a developing apparatus including a developing section, desilverization section, cleaning section or stabilizing section, and drying section, and further developing apparatus includes a means for automatically conveying photosensitive materials successively.

In general, when photosensitive materials are processed in the automatic developing apparatus, processing solutions are replenished into the processing tanks so that the activity of the processing solutions can be maintained constant. This system is widely employed. Specifically, while a replenishing solution is appropriately supplied from a replenishing tank to a processing tank, the processing work is carried out. In this case, it is common that the replenishing solution to be stored in the replenishing tank is prepared in another place and replenished into the replenishing tank when necessary. When the replenishing solution is prepared, conventionally, the following manual method is employed.

Processing agents used for silver halide photosensitive materials, which will be referred to as photographic processing agents hereinafter, are put on the market in the form of powder or liquid. When a powdery processing agent is put into use, it is manually dissolved in a predetermined amount of water, and when a liquid processing agent is put into use, it is diluted with a predetermined amount of water since it is condensed. Usually, the replenishing tank is arranged on the side of the photosensitive material processing apparatus. Therefore, it is necessary to provide a relatively large space for the installation of the apparatus. In minilaboratories, the number of which is sharply increased in these days, the replenishing tanks are arranged in the automatic developing apparatus body for silver halide photosensitive materials. Also, in this case, it is necessary to secure a space for installing the replenishing tank.

In order to provide an excellent photographic processing performance, a replenishing processing agent is divided into several parts. For example, a replenishing solution of the bleaching and fixing solution for use in color photography is divided into two parts, one is a part of organic acid ferric salt which is an oxidant, and the other is a part of thiosulfate which is a reducing agent. In the process of preparing the replenishing agent, the dense part of organic acid ferric salt and the dense part of thiosulfate are mixed and a predetermined amount of water is added to the mixture. In this way, the replenishing solution is provided. Each part of the replenishing solution described above is put, for example, in a container made of polyethylene, and a plurality of containers are packaged in a bag, for example, in a corrugated paper box. This packaged containers are put on the market as one unit.

As described above, the aforementioned parts of the replenishing agent are formed into a kit. This replenishing agent is dissolved, diluted and mixed, so that a predetermined amount of agent can be prepared. Disadvantages of the above replenishing agent are described as follows: First, the replenishing agent of each part is respectively put into a container. Therefore, several container are required, and the number of the containers is increased so as to prepare one unit of replenishing agent. Therefore, a large space is required for storage and conveyance. The second disadvantage is disposal of waste containers. Recently, in Europe and America, there is a strong demand of preservation of the environment and saving of resources. In the field of photography, disposal of containers made of polyethylene causes a big problem. Polyethylene containers used for photography are inexpensive and convenient for storage and transportation, and further they are highly resistant to chemicals. However, polyethylene containers are not provided biodegradation properties. Further, when they are stocked and incinerated, a large quantity of carbonic acid gap is generated, which causes various environmental problems such as an increase in the temperature of the earth and acid rain. When a large number of polyethylene containers are stocked in the user's yard, problems are caused because they are piled in heap and large spaces are occupied, and further it is difficult to crush them since their mechanical strength is high. The third disadvantage is that the chemicals are very unstable. For example, a color development replenishing solution is prepared in the following manner. After a predetermined amount of water has been put into the replenishing tank, a condensed solution kit A containing a preserving agent is added and agitated in the water, and then a condensed solution kit B containing a color developing agent is added and agitated. After that, a condensed solution kit C containing an alkaline agent. Finally, water is added so that a predetermined amount of solution is prepared. In this case, several problems are caused. For example, when the solution was not sufficiently agitated or water was not put into the container by a careless mistake, crystals of the color developing agent tend to precipitate, and the precipitation stays in the bellows pump, so that the solution can not be appropriately replenished, which deteriorates the photographic performance and further the bellows pump is damaged. The condensed solution kit is not necessarily used immediately after the manufacture. In some cases, it is used after one year from the manufacture. Accordingly, there is a possibility that the color developing agent or preserving agent is oxidized, so that the performance of the solution is deteriorated.

It is known that the color development replenishing solution made of a condensed solution kit or powder causes some problems in the replenishing tank. For example, when the replenishing solution is not used over a long period of time, crystals are deposited on the wall surface of the replenishing tank, and further the replenishing solution tends to be oxidized and tar is generated. Depending on the preserving condition, for example, the color developing agent precipitates at low temperature. Due to the foregoing, the manufacturer specifies the preserving condition of the replenishing solution so that the condition can be maintained by the user.

The above problems caused when the condensed solution kit or powder is used to prepare the replenishing solution are not limited to the color developing agent, but the same problems are caused in the cases of a bleaching and fixing agent, bleaching agent and fixing agent. Different from the aforementioned method in which the condensed solution kit or powder is used to prepare the replenishing solution, another method is known in which the condensed solution kit is directly replenished. According to this method, the condensed solution kit is directly replenished into the processing tank using a supply means such as a bellows pump, and at the same time, a predetermined amount of water is independently supplied. According to this method, it is not necessary to prepare the solution. Since the replenishing solution is not made, no problems are caused in preservation.

However, even in the aforementioned method, many problems are caused, which will be described below. According to the method, the condensed solution kit is supplied. Therefore, it is necessary to provide a tank for the condensed solution kit, and it is also necessary to provide a pump for supplying the condensed solution kit. As a result, the dimensions of the automatic developing apparatus are increased. According to the conventional replenishing system, it is sufficient that one tank and one pump are provided for each replenishing solution, that is, it is sufficient that three tanks and three pumps are provided. As compared with the conventional replenishing system, the numbers of tanks and pumps are increased, and further a pump for compensating water is required.

Further, the condensed solution kit is disadvantageous in that crystals tend to precipitate at a position close to the discharge port of the replenishing nozzle. Since the supply accuracy of a bellows pump is not so high that the replenishing accuracy tends to deviate when a highly dense solution is replenished, and the photographic performance is lowered. Concerning the problem of the container, the number of used polyethylene containers in this condensed solution kit system is the same as that of the conventional replenishing system. Therefore, the same problems are caused.

In order to solve the above problems, when a dissolving section is communicated with the processing tank in which the processing solution for processing silver halide photosensitive materials is stored and the solid processing agent is supplied and dissolved in this dissolving section, it is possible to make the automatic developing agent compact, and it is also possible to eliminate the manual dissolving work. Therefore, the photographic performance can be stabilized in the processing system. Further, the number of used polyethylene containers is reduced, and the environmental pollution can be lowered.

However, since the processing agent supply section for supplying a solid processing agent to the automatic developing apparatus is arranged in the vicinity of the processing solution whose temperature is controlled, the processing agent supply section is placed in a condition of high temperature and humidity. Therefore, dew condensation occurs in the processing agent supply section, the dew condensation may be a cause of corrosion or electric leakage.

The solid processing agent is affected by humidity. Therefore, even if countermeasure is taken to prevent humidity, moisture is absorbed by the solid processing agent. As a result, the solid processing agent is denatured or deposited on other members, and can not be supplied appropriately.

The present invention has been accomplished in view of the above circumstances. The first object of the invention is to attain the following that, the processing agent supply section is capable of moving and it is easy to conduct maintenance on the processing agent supply section, and further it is possible to prevent corrosion and electric leakage caused by dew condensation. When the processing agent supply section is moved during the stoppage of the apparatus, the occurrence of dew condensation can be prevented, and the occurrence of corrosion and electric leakage can be reduced. It is possible to prevent the solid processing agent from absorbing moisture, and denature of the processing agent is prevented. Also, the processing agents are prevented from adhering to each other and to other members. The first object is further to appropriately supply the processing agent in this way. The second object of the invention is to attain that, when the processing agent supply section is moved, the processing solutions are not mixed with each other, and contamination is prevented. The third object of the invention is to attain that, the processing agent supply section is easily moved.

SUMMARY OF THE INVENTION

In order to accomplish the first object, the present invention is to provide an automatic developing apparatus for silver halide photosensitive materials comprising: a processing tank in which a processing solution for processing silver halide photosensitive materials is stored; a dissolving section for dissolving a solid processing agent, the dissolving section being communicated with the processing tank; an accommodating section for accommodating the solid processing agent; a supply mechanism or a supply member for supplying the solid processing agent from the accommodating section to the dissolving section; and a supply passage member forming a passage for guiding the supplied solid processing agent to the dissolving section, wherein the processing agent supply section composed of the accommodating section and the supply mechanism is released from a condition in which the processing agent supply section is connected with the dissolving section, so that the processing agent supply section is capable of moving.

In this connection, a phrase of "being capable of moving" described in the present invention is defined as a structure in which removal of the processing agent supply section and other parts is not necessary, and the processing agent supply section is returned to a condition in which the processing agent supply section is connected with the dissolving section and also the processing agent supply section is removed.

According to a preferable embodiment of the invention, it is possible for the processing agent supply section is released from a condition in which the processing agent supply section is connected with the dissolving section, and the processing agent supply section is capable of moving to a position distant from an upper position of the opening of the dissolving section.

According to a preferable embodiment of the invention, when the processing agent supply section is moved, it is moved in a direction approximately perpendicular to the direction in which the photosensitive material is conveyed.

In this case, "the direction in which the photosensitive material is conveyed" is defined as a direction in which the photosensitive material is substantially directed, and the snaking motion of the photosensitive material is neglected here.

According to a preferable embodiment of the invention, when the processing agent supply section is moved, a connecting portion between the supply mechanism and the supply passage is disconnected.

According to a preferable embodiment of the invention, the processing agent supply section is released from a condition in which the processing agent supply section is connected with the dissolving section, and the processing agent supply section is moved, and this moved processing agent supply section is held at a predetermined position by a moving and holding means or a setting member.

In order to accomplish the second object, when the processing agent supply section is moved, a processing agent supply apparatus for supplying the solid processing agent to the dissolving section communicated with other processing tanks does not pass over the developing tank and the upper portion of the opening of the dissolving section communicated with the developing tank.

According to a preferable embodiment of the invention, a cover is provided which covers an open portion of the disconnected section on the fixed side when the processing agent supply section is moved.

In order to accomplish the third object, the processing agent supply section is integrally attached to an opening and closing member, and when this opening and closing member is opened and closed, the processing agent supply section is moved.

According to a preferable embodiment of the invention, a plurality of processing agent supply sections are provided in accordance with the processing tanks, and these plurality of processing agent supply sections are capable of moving simultaneously by one operation.

In the invention, the processing agent supply section is capable of moving while it is released from a condition of connection with the dissolving section. When the processing agent supply section is moved, the apparatus can be easily maintained. Therefore, the occurrence of corrosion or electric leakage caused by dew condensation can be prevented.

Under the condition that the processing agent supply section is connected with the dissolving section, it is possible to charge the solid processing agent from the processing agent supply section into the dissolving section.

For example, when the apparatus is not operated, the processing agent supply section is moved. When processing agent supply section is moved in this routine manner, it is possible to prevent dew condensation, so that the occurrence of corrosion and electric leakage can be reduced. Further it is possible to prevent the solid processing agent from absorbing moisture. Therefore, the solid processing agent is not denatured. It is also possible to prevent the solid processing agent from being clogged or deposited on other members. In this way, the solid processing agent can be appropriately supplied.

In the invention, when the processing agent supply section is moved, the processing solution is not deposited on the processing agent supply section so that the processing solution is not mixed with other solutions. In this way, contamination caused by the mixture of solutions can be prevented.

In the invention, the solid processing agent supply section is moved by an opening and closing means, or a plurality of processing agent supply sections can be simultaneously moved. In this way, the processing agent supply sections can be easily moved.

DETAILED DESCRIPTION OF THE PREFERRED EMBODIMENT

Figure 1:
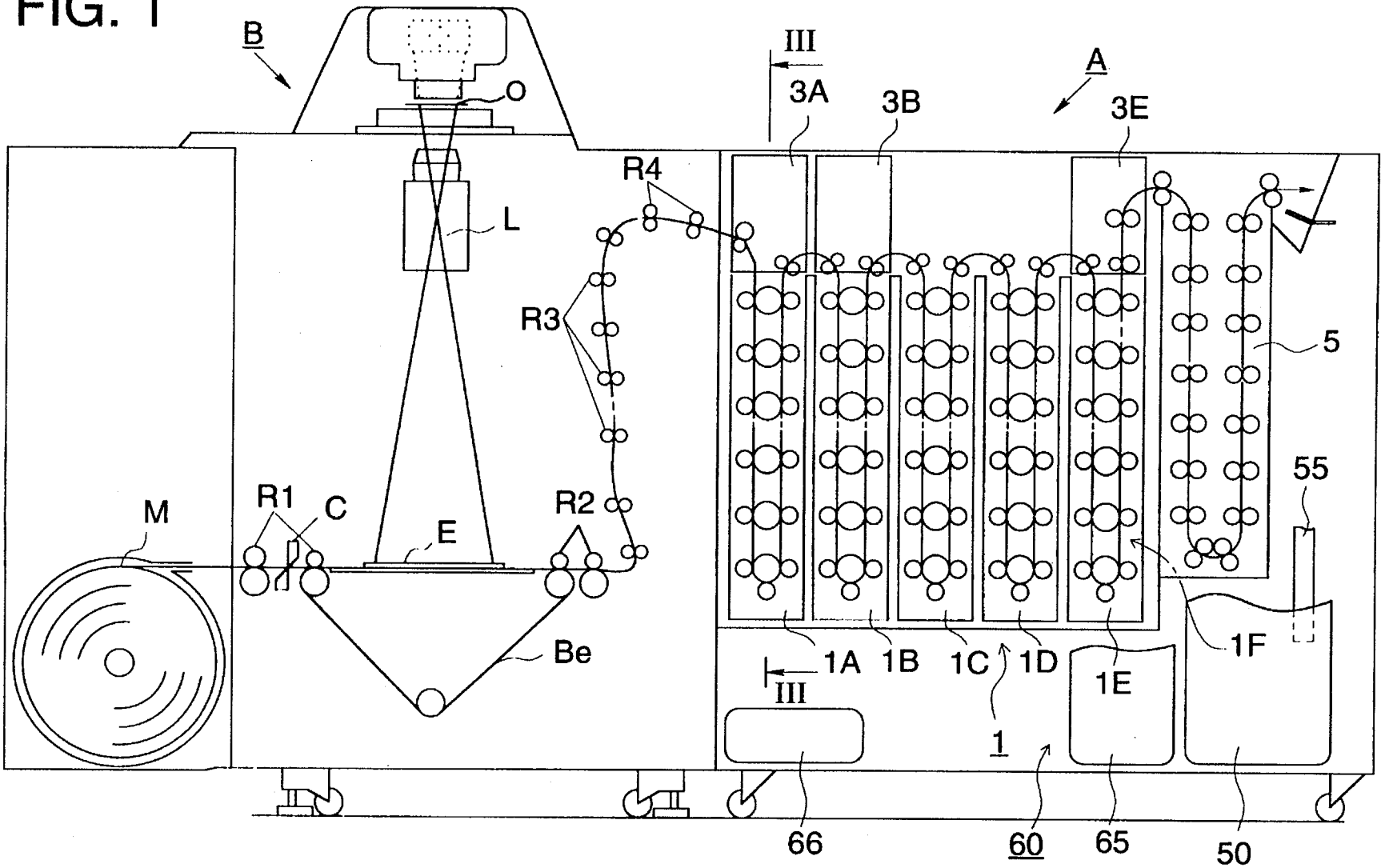
FIG. 1 is a schematic illustration showing an arrangement of the photosensitive material processing apparatus in which automatic developing apparatus A and photographic printer B are integrated.
Figure 2:
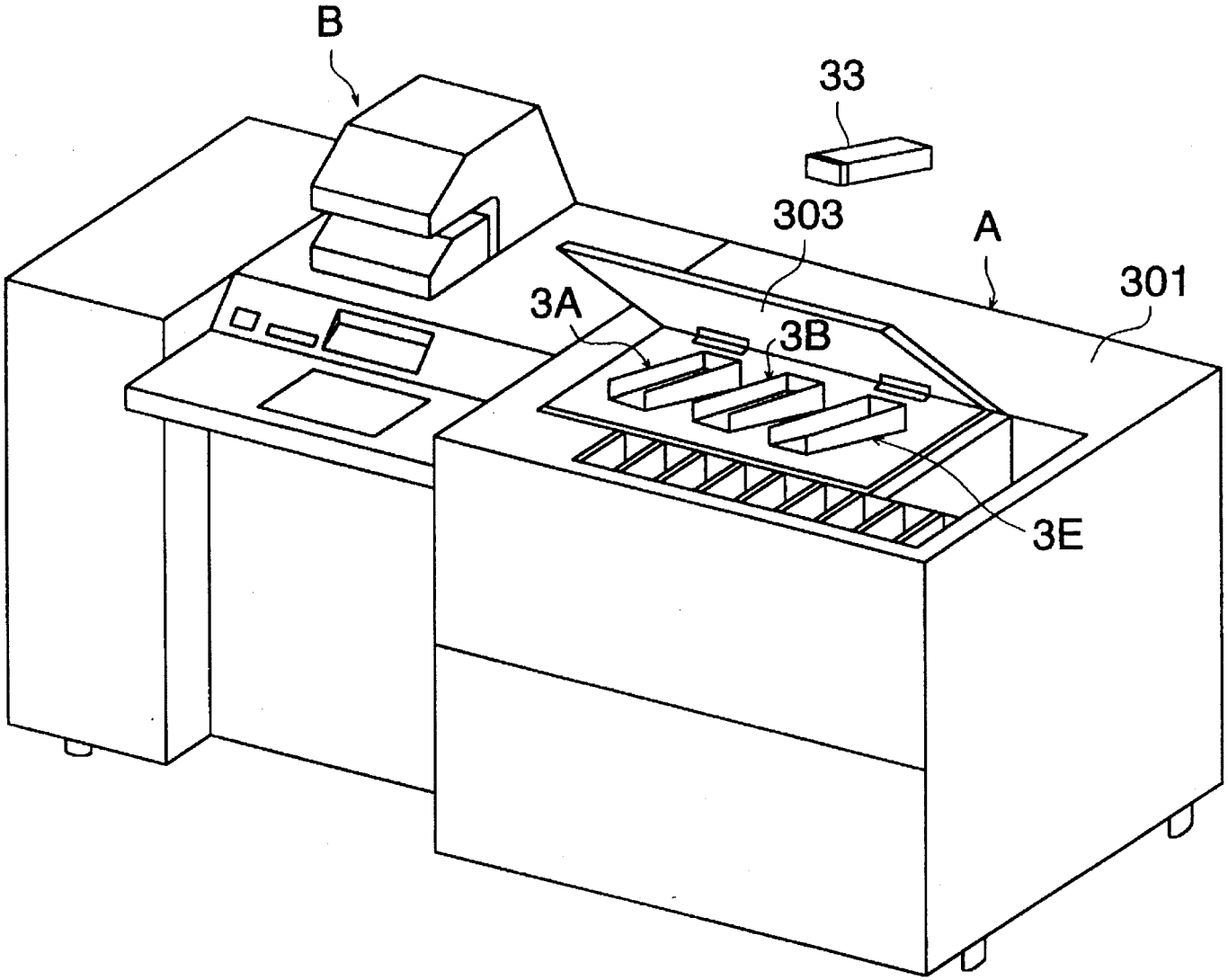
FIG. 2 is a perspective view of the photosensitive material processing apparatus.

Next, with reference to the accompanying drawings, an example of the photosensitive material processing apparatus of the present invention will be described as follows. FIG. 1 is a schematic illustration showing an arrangement of the photosensitive material processing apparatus in which automatic developing apparatus A and photographic printer B are integrated. FIG. 2 is a perspective view of the photosensitive material processing apparatus.

In FIG. 1, in the left lower portion of the photographic printer B, there is provided a magazine M in which a roll of photographic paper, which is an unexposed silver halide photographic material, is accommodated. The photographic paper is pulled out from the magazine M and conveyed by the feed rollers R1 and cut into a predetermined size by the cutter Ct. In this way, a sheet of photographic paper can be provided. This sheet of photographic paper "pa" is conveyed by the belt conveyance means Be. Then an image of the original O is exposed onto the sheet of photographic paper by a light source and lens L in the exposure section E. The exposed sheet of photographic paper is further conveyed by a plurality of pairs of feed rollers R2, R3 and R4, so that the sheet of photographic paper is introduced into the automatic developing apparatus A. In the automatic developing apparatus A, the sheet of photographic paper is successively conveyed by a roller conveyance means 1F into the color development tank 1A, bleaching and fixing tank 1B and stabilizing tanks 1C, 1D, 1E, wherein these tanks substantially compose a processing tank 1. Due to the foregoing, the sheet of exposed photographic paper is subjected to color development, bleaching and fixing processing and stabilizing processing. After the processing has been completed, the sheet of photographic paper is dried by the drying section 5, and then discharged outside of the apparatus A.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention. The explanation of the present invention is made under the condition that the automatic developing apparatus includes the color development tank, bleaching and fixing tank and stabilizing tanks, wherein these tanks substantially compose a processing tank. However, it should be noted that the present invention is not limited to the specific example. The present invention can be applied to an automatic developing apparatus having four tanks of a color developing tank, bleaching tank, fixing tank and stabilizing tank.

Automatic developing apparatus A is provided with processing agent replenishing devices 3A, 3B, 3E. The processing agent replenishing devices 3A, 3b, 3E respectively replenish the solid processing agent to the color developing tank 1A, bleaching and fixing tank 1B, and stabilizing tanks 1C, 1D, 1E, which compose the processing tanks 1. The water replenishing device 60 replenishes water to the processing tanks 1. The water replenishing device 60 includes a water replenishing pump 66 and water replenishing container 65. The waste solution collecting pipe 55 guides a waste solution that has overflowed the processing tanks 1. There is provided one waste solution container 50, and all waste solution is collected by the waste solution collecting pipe 55 and stocked in the waste solution container 50.

Figure 3:
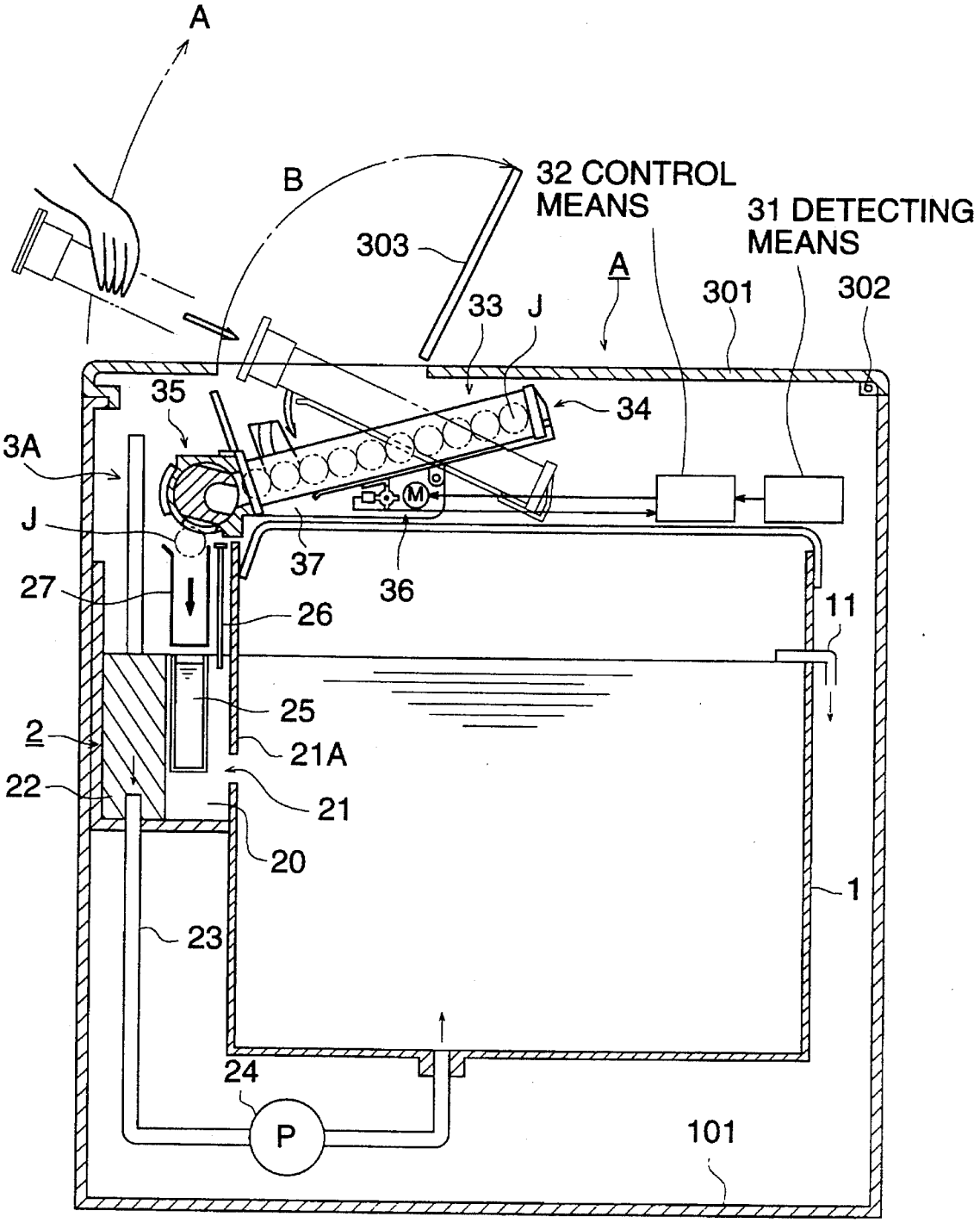
FIG. 3 is a sectional view of the automatic developing apparatus taken on line III—III in FIG. 1, wherein the processing agent replenishing apparatus for the color developing tank is shown.

FIG. 3 is a sectional view of the processing agent replenishing device 3A of the color development tank 1A of the automatic developing apparatus A taken on line III—III in FIG. 1. In this case, the construction of the bleaching and fixing tank 1B and that of the stabilizing tanks 1C, 1D, 1E are the same as the construction of the color development tank 1A. Therefore, the explanation of the processing tank 1 can be applied to all tanks of the color development tank 1A, bleaching and fixing tank lB, and stabilizing tanks 1C, 1D, 1E. In this connection, for enhancing the understanding of the invention, the conveyance means for conveying the photosensitive material is omitted in the drawing. In this example, explanations will be made under the condition that tablets of solid processing agent are used.

The processing tank 1 for processing the photosensitive material includes a dissolving section 2 for dissolving the solid processing agent J, and the solid processing agent J is supplied to this dissolving section 2. The dissolving section 2 is integrally attached onto the outside of a partition wall forming the processing tank 1. The dissolving section 2 includes a constant temperature tank 20. The processing tank 1 and constant temperature tank 20 are separated by a partition wall 21A on which a communicating hole 21 is formed so that the processing solution can be communicated through the communicating hole 21. Since an enclosure 25 for receiving the tablets J of solid processing agent is provided at an upper position of the constant temperature tank 20, the tablets J of solid processing agent are not moved to the processing tank 1 in the form of a solid body. In this connection, the enclosure 25 is made of material such as a net or filter so that the processing solution can pass through the enclosure 25, however, the tablet J in the form of a solid body can not pass through the enclosure 25 until it is dissolved in the solution.

A cylindrical filter 22 is attached to the constant temperature tank 20 in such a manner that the cylindrical filter 22 can be replaced. The cylindrical filter 22 removes paper scraps and others in the processing solution. A circulation pipe 23 connected with the suction side of a circulation pump 24 is inserted into the filter 22 passing through the lower wall of the constant temperature tank 20. One end of the circulation pipe 23 is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 20 and discharged into the processing tank 1, so that the discharged processing solution is mixed with the processing solution in the processing tank 1, and then sent to the constant temperature tank 20. In this way, the processing solution is circulated. In this connection, the circulating direction of the processing solution is not limited to the direction illustrated in FIG. 3. The circulating direction of the processing solution may be reverse.

A waste solution pipe 11 is provided for permitting the processing solution in the processing tank 1 to overflow, so the solution level can be maintained constant and an increase in the components conveyed from other tanks into the processing tank 1 can be prevented. Further, an increase in the components oozing out from the photosensitive material can be prevented. The waste solution is collected by a waste solution collecting pipe 55 shown in FIG. 1 and stocked in a waste solution container 50.

A rod-shaped heater 26 is dipped in the processing solution in the constant temperature tank 20. The processing solution in the constant temperature tank 20 and processing tank 1 is heated by this heater 26. In other words, the heater 26 is a temperature regulating means for regulating the temperature of the processing solution in the processing tank 1.

A throughput information detecting means 31 is disposed at an entrance of the automatic developing apparatus A, and detects the throughput of the photosensitive material to be processed. This throughput information detecting means 31 is comprised of a plurality of detecting members that are disposed in a transverse direction. This throughput information detecting means 31 detects the width of photosensitive material, and the result of detection is used for counting the detection time. Since the conveyance speed of photosensitive material is previously set in a mechanical manner, the throughput of photosensitive material, that is, the area of processed photosensitive material can be calculated form the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIG. 1, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. In the above explanation, detection is conducted on the area of processed photosensitive material, however, the present invention is not limited to the specific example. For example, any values proportional to the throughput of photosensitive material may be adopted. For example, a concentration of the processing solution in the processing tank or a change in the concentration may be used. It is not necessary to provide the throughput information detecting means 31 for each processing tank 1A, lB, 1C, 1D, 1E, and it is preferable that one throughput information detecting means 31 is provided for one automatic developing apparatus A. Reference numeral 32 is a throughput supply control means for controlling the supply of processing solution in accordance with a signal sent from the throughput information detecting means 31. The signal is received by the throughput supply control means 32, and the drive means 36 is driven, so that the throughput supply of the solid processing agent J is controlled.

The processing agent replenishing device 3A is arranged at a position above the processing tank of automatic developing unit A used for processing exposed photosensitive materials. The processing agent replenishing device 3A includes: an accommodating section 34 in which the accommodating container 33 for accommodating the solid processing agent J is provided to stock the solid processing agent J; a supply mechanism 35 for sending the solid processing agent J from the accommodating section 34 to the dissolving section 2; and a supply passage 27 for guiding the solid processing agent J to the dissolving section 2. The processing agent supply section 37 is composed of the accommodating section 34 and the supply mechanism 35. When the processing agent supply section 37 is released from the dissolving section 2, it can be moved.

The processing agent replenishing device 3A is tightly closed up by an upper cover 301. The upper cover 301 is rotatably attached to a shaft 302 mounted on the main body 101 accommodating the processing tank 1 and the constant temperature tank 20. When the upper cover 301 is lifted upward in the direction of arrow A, the front and upper sides of the apparatus are widely open to an operator. Under the above condition, the processing agent replenishing device 3A can be maintained and the filter 22 can be replaced.

A skylight 303 is formed on an upper surface of the upper cover 301. This skylight 303 is rotatably connected, so that the skylight 303 is opened in the direction of arrow B and the accommodating container 33 is attached and replaced.

Figure 4:
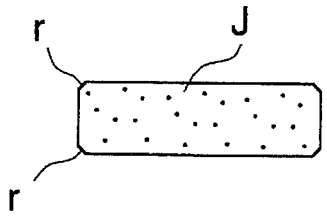
FIGS. 4(A) through 4(G) are views showing various configurations of the tablet type solid processing agents.
Figure 4:
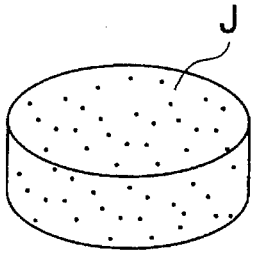
Figure 4:
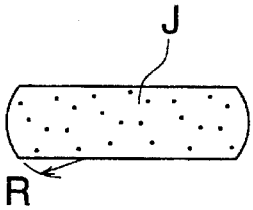
Figure 4:
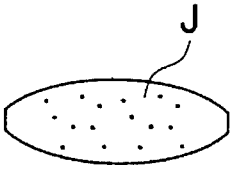
Figure 4:
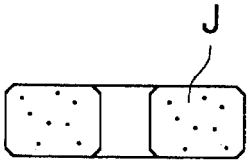
Figure 4:
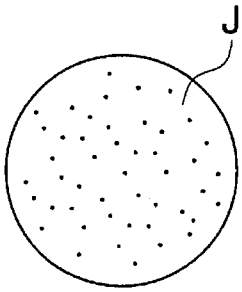
Figure 4:
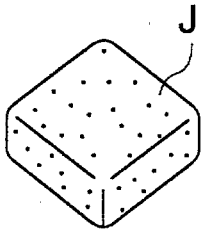

There are provided granule, powder, tablet and pill types of solid processing agents J. In this case, a tablet type processing agent is taken for an example. In FIGS. 4(A) through 4(G), various configurations of the tablet type of solid processing agent J are shown. FIG. 4(A) is a sectional view of the cylindrical flat tablet type solid processing agent J, wherein the configuration is circular and the corners are chamfered by the radius of curvature of r. FIG. 4(B) is a perspective view of the tablet type solid processing agent J. FIG. 4(C) is a sectional view of the flat tablet type solid processing agent J, wherein the configuration is circular, and the upper and lower surfaces are flat, and the circumferential surface is formed convex by the radius of curvature of R. FIG. 4(D) is a sectional view of the tablet type solid processing agent J, wherein the configuration is flat, and the upper and lower surfaces are formed spherical. FIG. 4(E) is a sectional view of the tablet type solid processing agent J, wherein the configuration is a doughnut-shape having a hole at the center. FIG. 4(F) is a view showing a spherical solid processing agent. FIG. 4(G) is a perspective view of the solid processing agent, the configuration of which is a rectangular parallelepiped.

Figure 5:
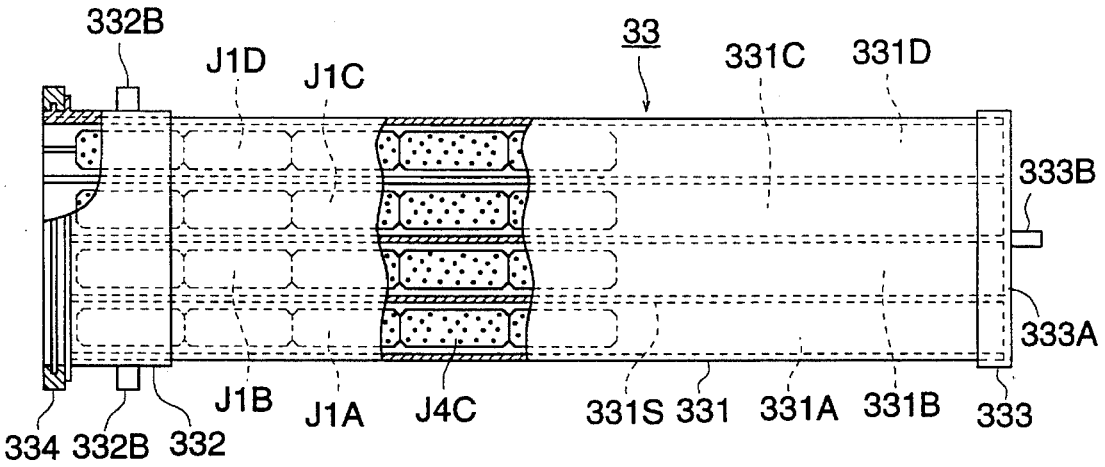
FIGS. 5(A) through 5(C) are views showing the container for accommodating the tablet type solid processing agents.
Figure 5:
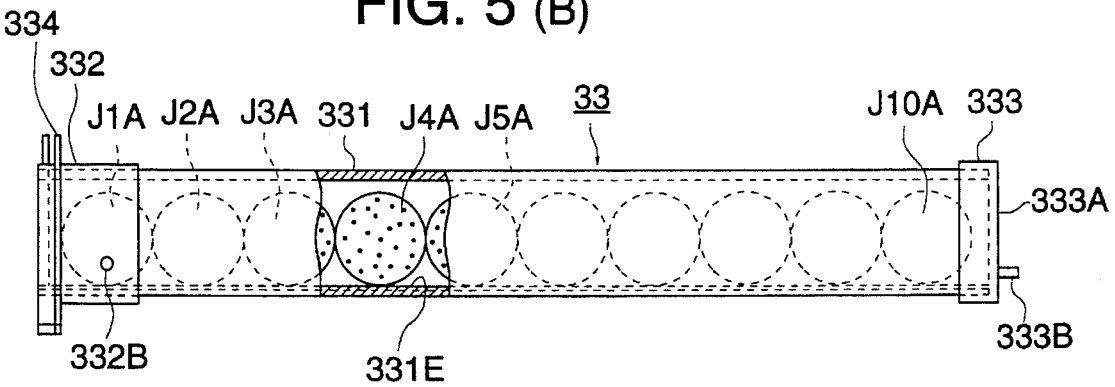
Figure 5:
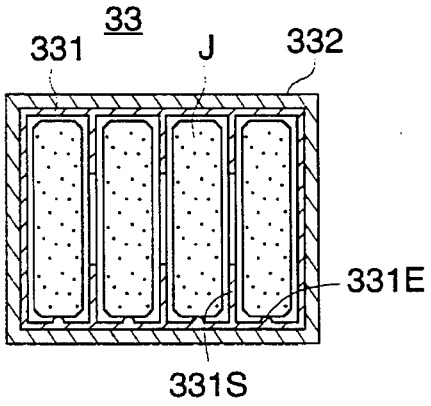
Figure 6:
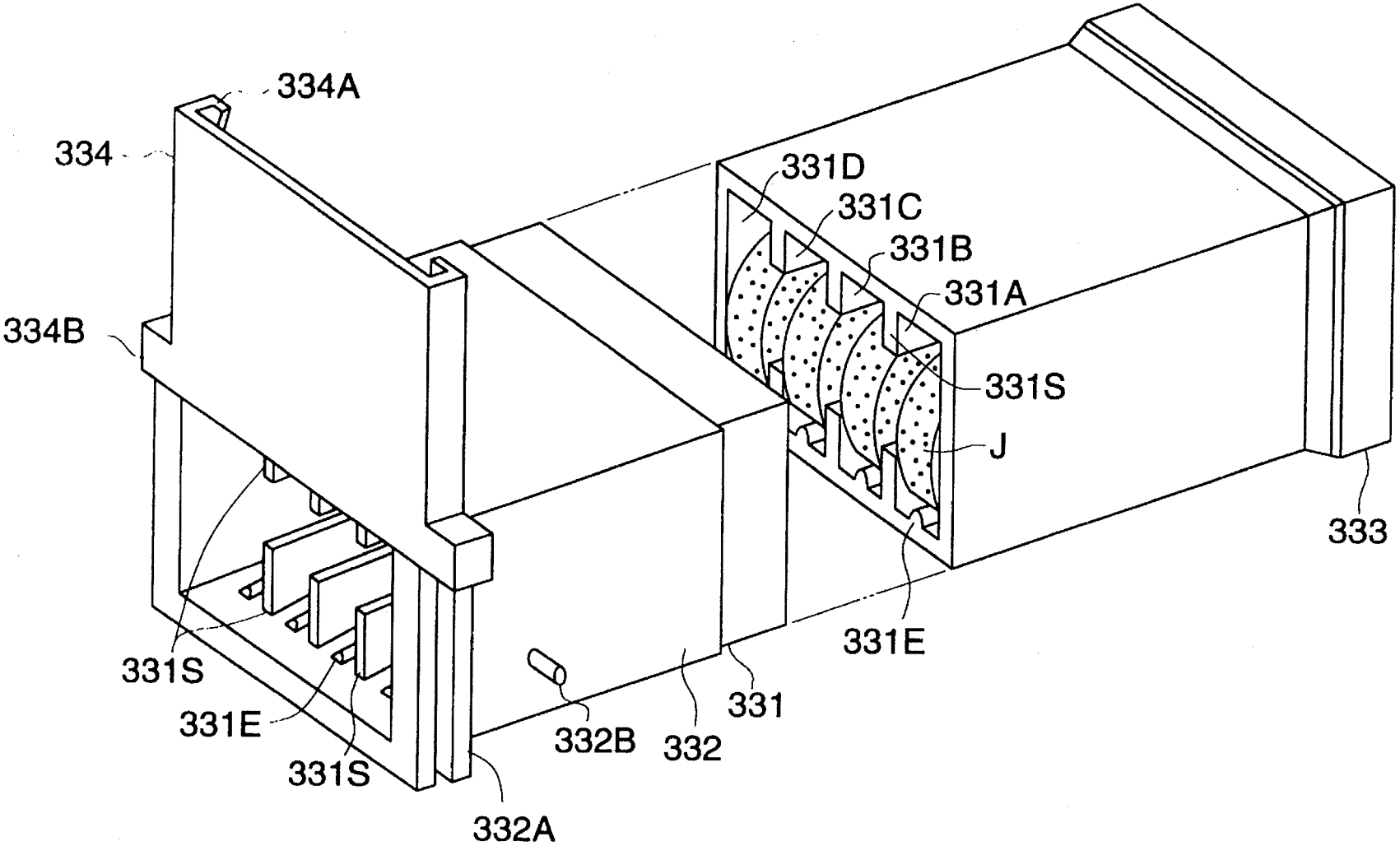
FIG. 6 is a perspective view of the accommodating container, wherein a portion is shown in an exploded condition.

FIGS. 5(A) through 5(C) are views showing the accommodating container (cartridge) 33 for accommodating the tablet type solid processing agent J. FIG. 5(A) is a plan view including a partially cutaway view. FIG. 5(B) is a side view of the accommodating container 33. FIG. 5(C) is a front view of the opening portion of the accommodating container 33 under the condition that the sliding cover 334 is removed. FIG. 6 is a perspective view of the accommodating container 33.

The accommodating container 33 includes: a container main body 331 for accommodating a plurality of tablet type solid processing agents J, the configuration of the container being a hollow square pillar; an outlet member 332 connected with one of the openings of the hollow container body 331 so that the solid processing agent J can be discharged from a discharge opening; a cap member 333 for closing the other opening of the container main body 331; and a sliding cover 334 capable of moving upward and downward being slid on the rail portion 332A of the outlet member 332.

Three sets of partition walls 331S are integrally fixed inside the container 331, so that the inside of the container 331 is divided into four chambers 331A, 331B, 331C, 331D. In each chamber, the approximately cylindrical tablets of solid processing agent J are longitudinally accommodated under the condition that each outer circumference is externally contacted with the inside wall of the chamber. Specifically, 10 tablets of solid processing agent J1A to J10A are accommodated in the first chamber 331A, and 10 tablets of solid processing agent J1B are accommodated in the second chamber 331B. In the same manner, the tablets J1C and J1D are respectively accommodated in the chambers.

A projection 331E is projected from the bottom surface of each chamber of the container main body 331. This projection 331E comes into a point of the outer circumferential surface of the tablet of solid processing agent J, so that the tablet can be easily moved, and powder separated from the tablet of solid processing agent J drops from the top of the projection 331E. Separated powder accumulates in a groove formed under the projection 331E. Accordingly, even when the powder is deposited in the groove, no problems are caused because the tablet of solid processing agent J moves on the projection 331E.

Rail portions 332A are provided on both outer sides of the outlet opening of the outlet member 332, and the rail portions 332A are engaged with groove portions 334A provided on both sides of the sliding cover 334. In this way, the sliding cover 334 is slid on the rail portions 332A. Protruding portions 334B which protrude from both lower portions of the sliding cover 334 are engaged with an opening and closing restricting member 355 described later, so that the sliding cover 334 is automatically opened and closed. Pins 332B protrude from both sides of the outlet member 332, and engage with cam grooves of the accommodating section 34 described later.

The back surface 333A of the cap member 333 is pushed by a resilient pushing member of the accommodating container charging means 34 described later, so that the accommodating container 33 is pressed against a reference surface of the supply means 35. A plurality of discriminating projections 333B are integrally provided on the back surface 333A of the cap member 333, and a wrong accommodating container in which a different processing agent is accommodated is prevented from being mounted by careless mistake.

Figure 7:
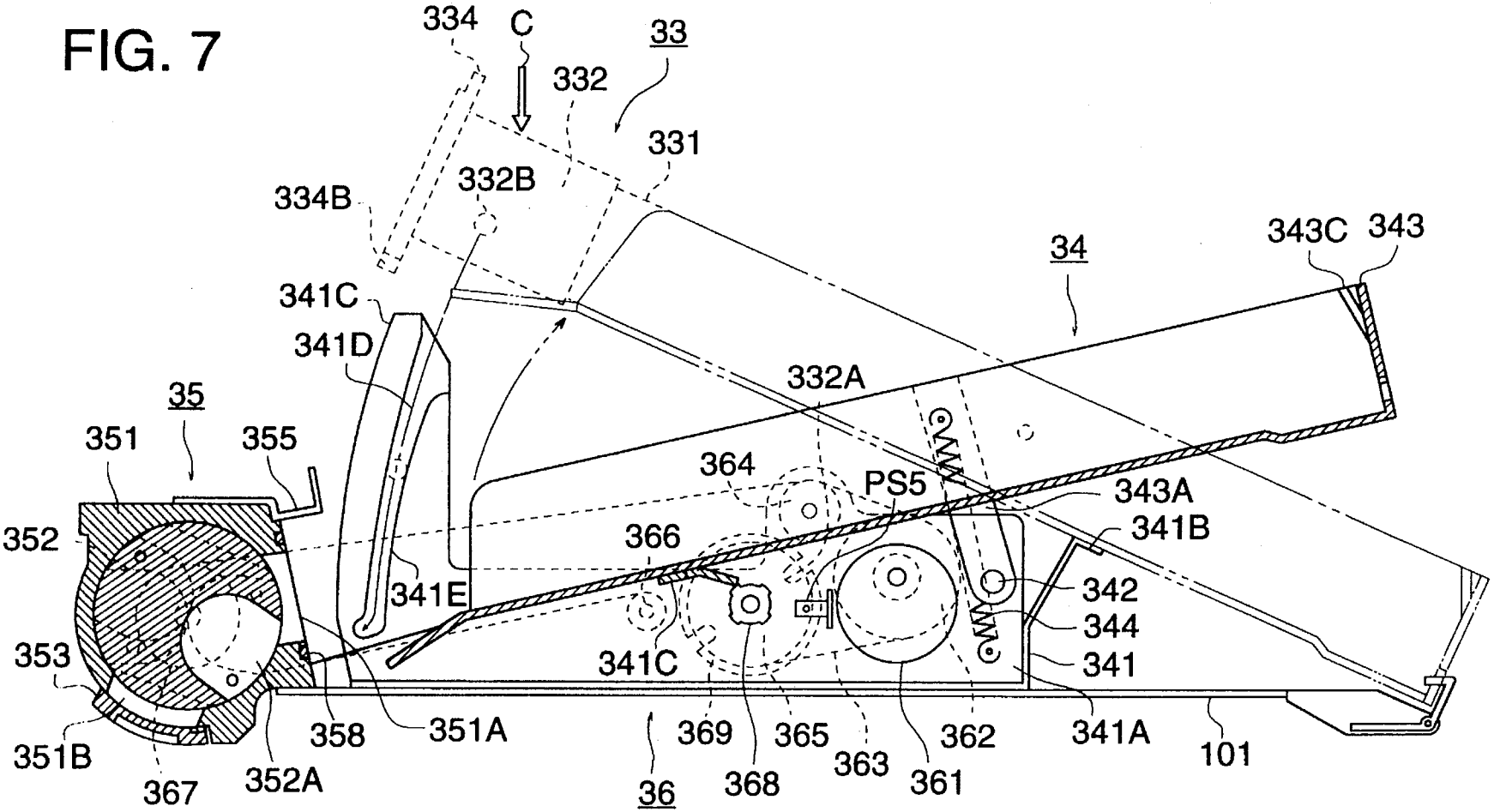
FIG. 7 is a sectional side view showing the accommodating container, accommodating section, supply mechanism and drive means, wherein the operation of the drive means is explained.

FIG. 7 is a sectional side view for explaining the operation of the accommodating container 33, accommodating section 34, supply mechanism 35 and drive means 36.

A fixed frame 341 of the accommodating section 34, a housing member 351 and drive means 36 are fixed on an upper portion of the main body 101.

Support shafts 342 are protruded from both side plates 341A of the fixed frame 341 at the right end shown in the drawing. The support shafts 342 are engaged in holes disposed at a lower end of an arm 343A fixed on both sides of a container holding member 343 for holding the accommodating container 33, so that the container holding member 343 can be oscillated around the support shaft 342. The side plate 341A and arm 343A are respectively provided with a fixing pin, and a tension spring 344 is attached to the fixing pin. Therefore, as illustrated by a one-dotted chain line in the drawing, the container holding member 343 is rotated clockwise being pushed by the spring, and the bottom portion of the container holding member 343 comes into contact with a stopper portion 341B protruding to a right upper portion of the fixed frame 341. Then the movement of the container holding member 343 is stopped, and the container holding member 343 is maintained in a condition before the accommodating container 33 is mounted, that is, the container holding member 343 is maintained at the first position.

At a position close to the left end of the side plate 341A of the fixed frame 341, there is provided a rising portion 341C, in which a circular guide groove 341D is formed, wherein the circular guide groove 341D is provided around the support shaft 342. The accommodating container 33 is charged to the container holding member 343 of the accommodating container charging means 34, and the accommodating container holding member 343 is oscillated around the support shaft 342, so that the left end portion of the container holding member 343 is pushed downward in the direction C shown in the drawing. Then the guide pin 332 of the accommodating container 33 advances in the guide groove 341D while the guide pin 332 is being pushed downward by a pushing member 343C of the accommodating container charging means 34. An L-shaped groove portion 341E is formed in the lowermost portion of the guide groove 341D. When the pin 332B enters this L-shaped groove 341E being pushed by the pushing member 343C, the front of the accommodating container 33 closely comes into contact with an entrance portion 351A of the supply mechanism 35.

The supply mechanism 35 is disposed in the housing member 351 in such a manner that the supply mechanism 35 can be rotated on an inner circumferential surface of the housing member 351. The supply mechanism 35 includes a rotatable rotor 352, and a shutter section 353 for opening and closing the outlet portion 351B, wherein the rotor 352 has a pocket portion 352A by which a predetermined amount of solid processing agent J is received from the inlet portion 351A and moved to the outlet portion 351B.

A frame-shaped resilient packing 358 is embedded in the periphery of the opening on the end surface of the inlet portion 351A of the housing member 351. When the discharge opening of the accommodating container 33 is closely contacted with the inlet portion 351A, the atmosphere can be shut off by the frame-shaped resilient packing 358, so that moisture-proofing effect can be provided.

Next, a drive means 36 of the processing agent replenishing device 3A will be explained below. The drive means 36 is arranged below the accommodating section 34. A timing pulley 362 is mounted on the drive shaft of the motor 361, and a timing belt 363 is wound around the timing pulley 362. When the timing belt 363 is driven, a pulley 367 mounted on the rotational shaft of the rotor 352 is rotated through pulleys 364, 365 and a tension pulley 366. A cam 368 is mounted on the same shaft as that of the pulley 365. A claw 341C is fixed onto the bottom surface of the container holding member 343 and engaged with a cam 368.

When the motor 361 is driven, the pulley 365 and the cam 368 are rotated. Then the protrusion of the cam 368 pushes up the claw 341C, and the cutout portion is separate from the claw 341C. When the cam 368 is rotated, impacts are repeatedly given to the claw 341C and the container holding member 343 integrated with the claw 341C. Due to the foregoing, the solid processing agent J in the accommodating container 33 rolls on the inclined surface of the container body 331 and moves to the delivery port. This motion is facilitated by the impact given to the units, so that the solid processing agent J does not stop halfway down the inclined surface.

On the same shaft as that of the pulley 365, a cutout disk 369 having two cutout portions are mounted. When a photo-interrupter type optical sensor PS5 detects that the cutout portion has passed, a position detecting signal is emitted by the sensor, and the rotor 352 is stopped when it has completed one cycle of operation.

In the above explanation, 4 pieces of solid processing agent J are dropped one by one. Therefore, when a supply passage 27 through which only one piece of solid processing agent J passes at the same time is provided below the supply mechanism 35, the solid processing agent J can be charged into a small space above the constant temperature tank 20. Accordingly, the filter 22 can be easily picked up for replacement. In this case, pieces of solid processing agent J are dropped while the phases of dropping operation are shifted. The object of shifting the phases is to prevent two pieces of solid processing agents J from engaging with each other. In this way, the solid processing agent J can be prevented from being blocked halfway in the supply passage 27. When the solid processing agent J is dropped one by one, it can be positively detected by the sensor. In this connection, the number of pieces of solid processing agent J dropped in one cycle of the rotor operation is not limited 2 as described above, but 4 pieces of solid processing agent J may be dropped when the rotor is rotated by one revolution.

Figure 8:
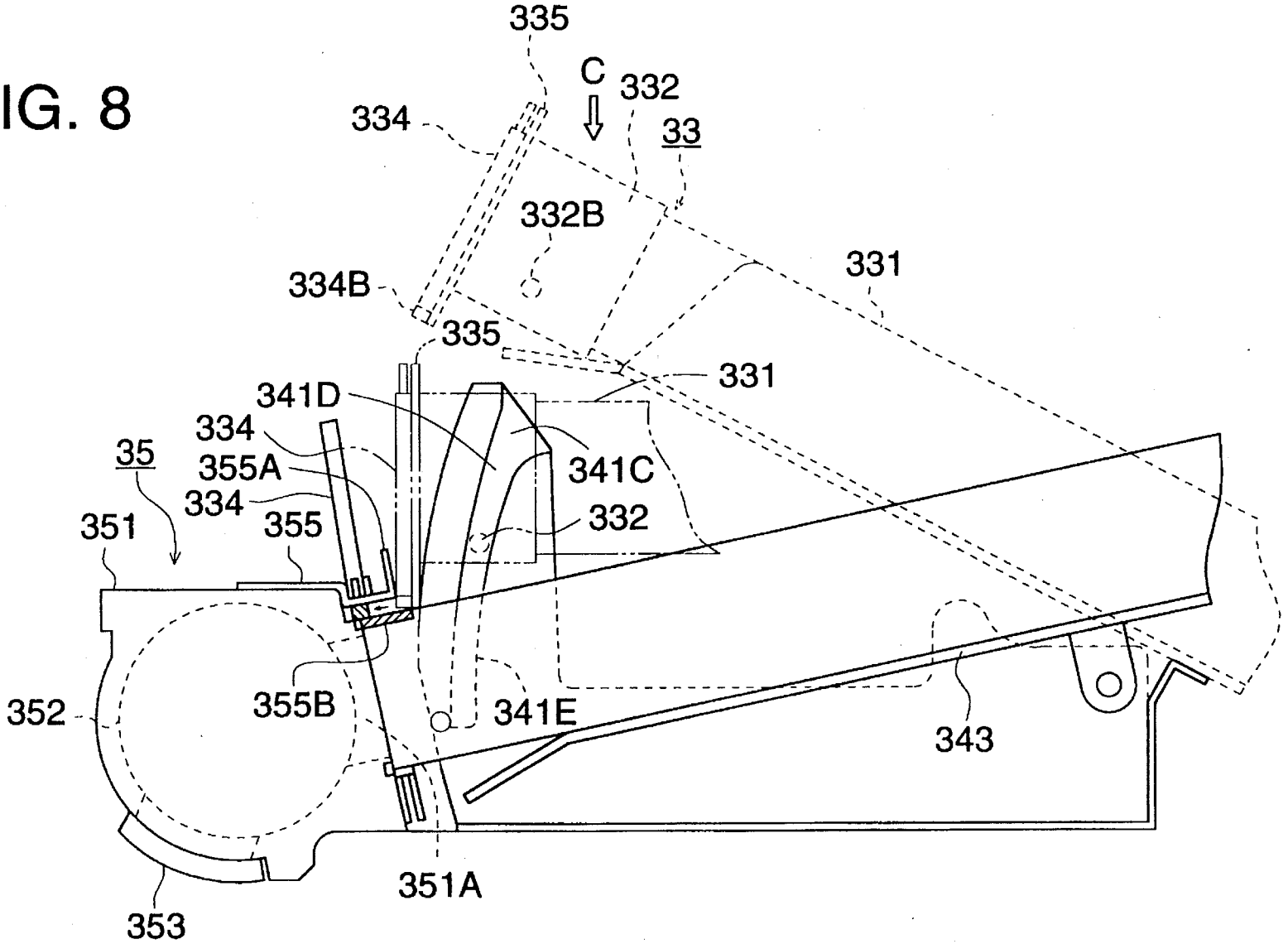
FIG. 8 is a perspective view showing a condition in which the opening and closing cover of the accommodating container is opened.

FIG. 8 is a side view for explaining the opening and closing operation of the sliding cover 334 of the accommodating container 33.

At an upper position of the inlet portion of the housing member 351 of the supply means 35, there is provided an opening and closing regulating member 355 for regulating the opening and closing operation of the sliding cover. When the accommodating container 33 provided in the accommodating container charging means 34 is pushed downward from the initial position (shown by a one-dotted chain line) in the direction of arrow C in the drawing, the accommodating container 33 reaches the intermediate position (shown by a one-dotted chain line). Then the descending motion of a protrusion 334B of the sliding cover 334 is stopped by the opening and closing regulating member 355(355B). When the accommodating container 33 is further oscillated, the opening of the outlet opening member 332 of the accommodating container 33 is gradually opened since the sliding cover 334 can not further go downward. When the downward motion of the accommodating container 33 is stopped at a predetermined position, the opening is completely opened, and the solid processing agent tablet J in the first row in the accommodating container 33 is sent to the supply means 35. This complete opening condition is shown by a solid line in the drawing.

When all solid processing agent tablets J in the accommodating container 33 have been successively consumed, a remainder detection signal is generated, and the accommodating container 33 is replaced in accordance with the signal. When the accommodating container 33 is withdrawn backward, the accommodating container 33 and container holding member 343 are rotated clockwise, so that the left end portion is raised. In this ascending process, the opening and closing regulating member 355A stops the motion of the sliding cover 334, and only the main body composed of the container main body 331 and the cap member 333 is raised, so that the opening portion is closed by the sliding cover 334. Further, in the latter half process in which the accommodating container 33 is raised, the apparatus is returned to the initial condition, which is an upper dead point, while the opening portion is in a closed condition. Therefore, powder of the processing agent in the container can be prevented from being scattered. Even when the container is removed for maintenance while the processing agent remains in the container, the processing agent can not be dispersed since the opening portion is in a closed condition.

Figure 9:
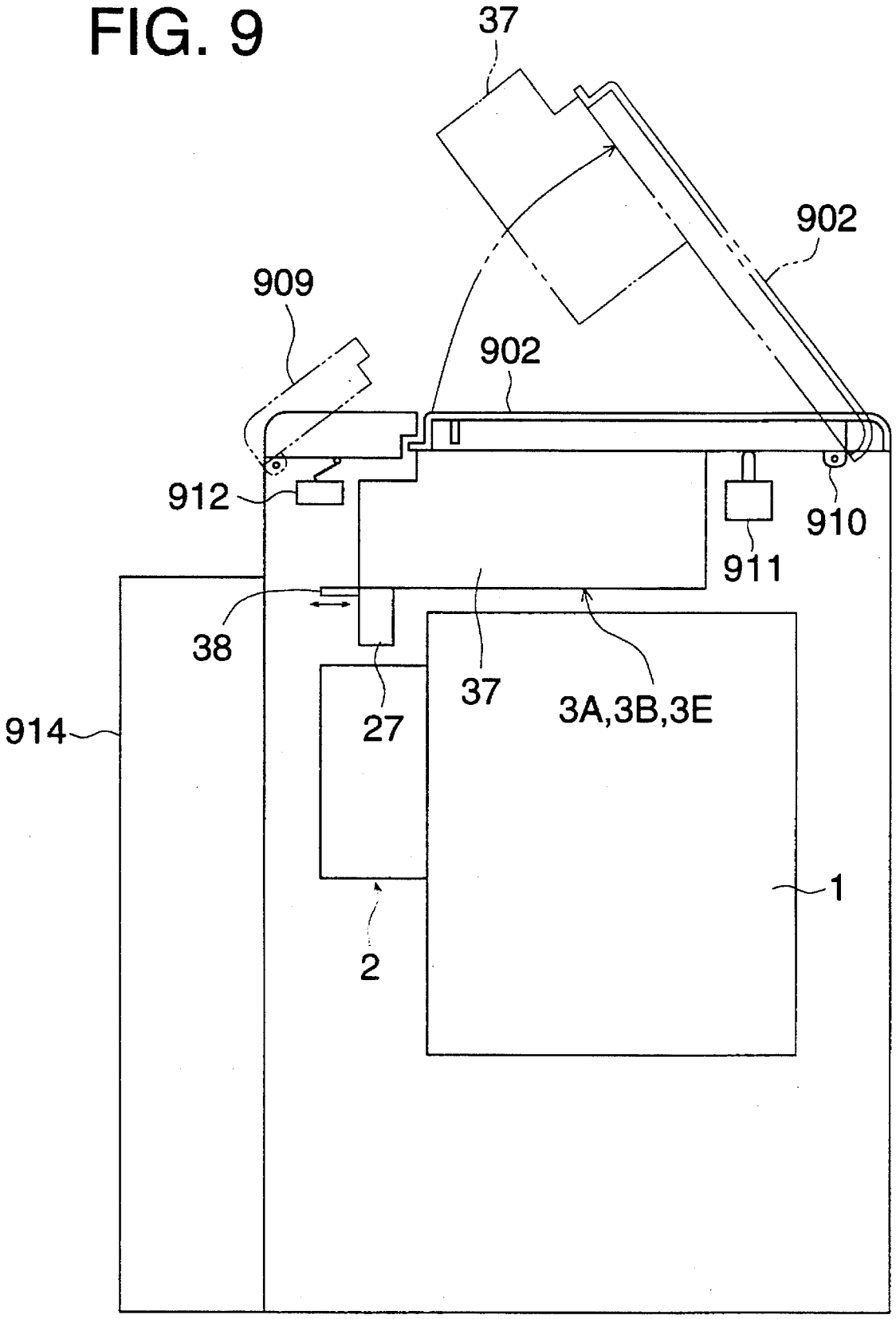
FIG. 9 is a sectional side view of the cover of the automatic developing apparatus.
Figure 10:
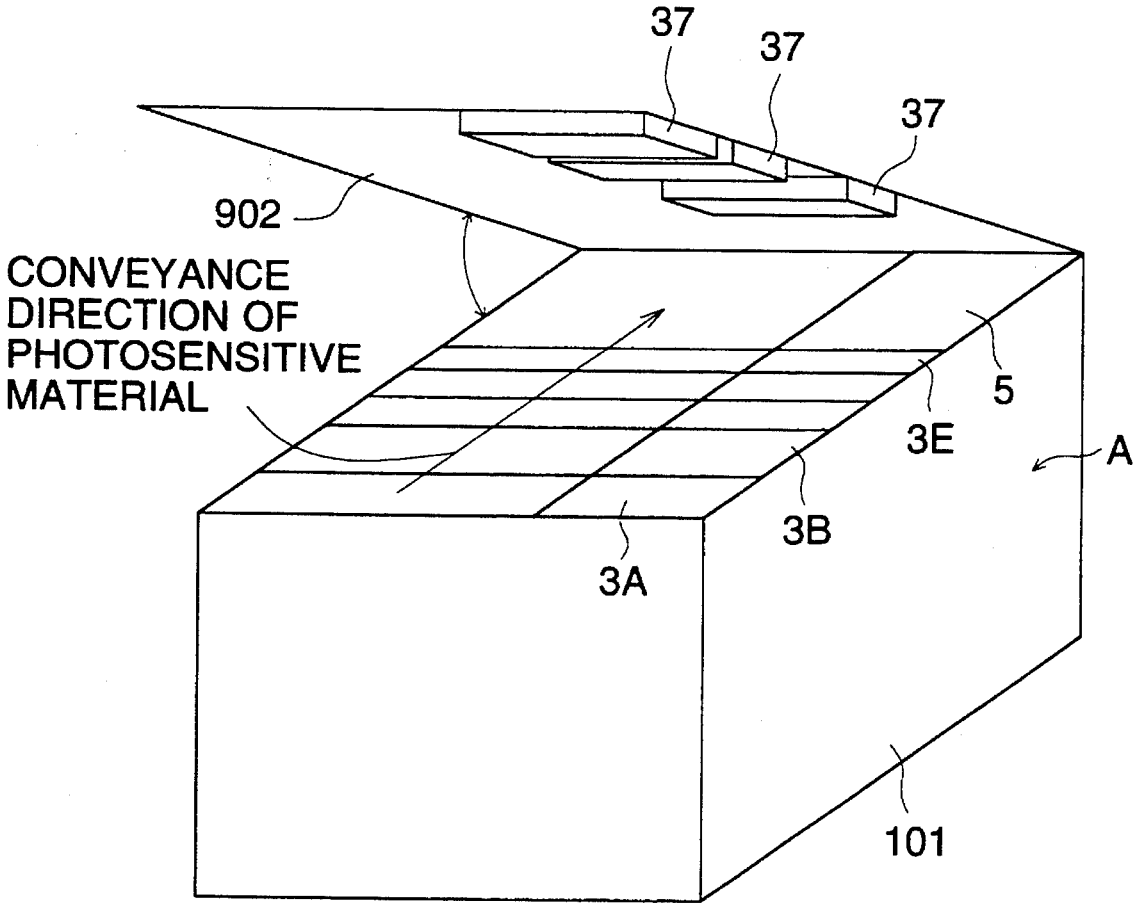
FIG. 10 is a view showing another example in which a plurality of processing agent supply sections are provided in accordance with the processing tanks of the automatic developing apparatus.

FIG. 9 is a sectional side view of the cover of the automatic developing apparatus A. In FIG. 9, the first cover 902 is open upward, that is, the first cover 902 is rotated upward around the hinge 910. These circumstances are shown by two-dotted chain lines in the drawing. Before the first cover 902 is opened, the second cover 909 is opened or removed, and the movement of the second cover 909 is detected by the sensor 912, and the processing agent supply section 37 composed of the accommodating section 34 and supply mechanism 35 is stopped at the home position.

When the first cover 902 has been opened, the sensor 911 detects the motion of the first cover 902, and the drive power source is turned off for safety. The dissolving section 2 is arranged being adjacent to the processing tank 1. While the processing agent supply section 37 is located at an upper position of the processing tank 1, a portion of the processing agent supply section 37 is protruded and located at an upper position of the dissolving section 2. Due to the above structure, the solid processing agent J is charged into the dissolving section 2 through the supply passage 27.

There is provided a sorter 914 on the left of the apparatus. In order to provide a space for maintaining the processing agent replenishing devices 3A, 3B, 3E, the upper surface of the apparatus is divided into the first and second covers 902, 909. Therefore, the covers can be open in small spaces, and further maintenance of the processing agent replenishing devices 3A, 3B, 3E can be easily carried out. Furthermore, an upper space of the processing tank is open, so that the processing tank 1 can be easily maintained. Consequently, jam clearance is easily performed.

Since the second cover 909 can be opened or removed, the processing agent supply section 37 located below the first cover 902 is exposed and maintained easily.

The processing agent supply section 37 of the processing agent replenishing devices 3A, 3B, 3E is attached onto the first cover 902, that is, the processing agent supply section 37 is integrally attached to the first cover 902 composing the opening and closing members. When the first cover 902 is opened and closed, the processing agent supply section 37 is moved, so that an exclusive member for moving the processing agent supply section 37 is not necessary and the structure is simple. Further, it is easy to move the processing agent supply section.

The processing agent replenishing devices 3A, 3B, 3E are provided in accordance with the processing tank 1. Due to the foregoing, a plurality of processing agent supply sections 37 are provided in accordance with the processing tank 1. The plurality of processing agent supply sections 37 are capable of simultaneously moving by one operation, that is, the processing agent supply section can be easily moved.

When the processing agent supply section 37 is moved in this example, a connecting section between the supply mechanism 35 and the supply passage 27 is disconnected, however, the connecting section is not limited to the above specific example, and the supply passage 27 and the supply mechanism 35 may be moved together while they are connected with each other. However, from the viewpoint of preventing contamination, the former example is preferable.

The processing agent supply section 37 is moved on a surface perpendicular to the direction in which the photosensitive material is conveyed. Accordingly, when the respective processing agent supply section 37 is moved, the processing agent is not deposited on the processing agent supply section 37, so that the processing agent is not mixed with other solutions. As a result, contamination can be prevented.

When the processing agent supply section 37 is moved, other processing agent supply sections for supplying the solid processing agent to the dissolving sections 2 communicated with other processing tanks do not pass above the upper opening of the dissolving section 2 communicated with the developing tank. Therefore, the developing solution are not mixed with other processing solutions. As a result, contamination can be prevented.

The dissolving section 2 is put in a condition of high temperature and humidity. In the case of charging, the processing agent supply section 37 is put in an environment of high humidity. However, it is possible that the processing agent supply section 37 is disconnected from the dissolving section 2 and moved to a position distant from the upper position of the opening of the dissolving section 2. Accordingly, for example, when the processing agent supply section 37 is moved in the case of stoppage of operation, the solid processing agent J can be prevented from absorbing the moisture, so that the solid processing agent J is not denatured. Further, it is possible to prevent the solid processing agent J from expanding or sticking to each other or other elements. In this way, the occurrence of inappropriate conveyance of the solid processing agent can be prevented.

The processing agent supply section 37 is integrally attached to the first cover 902, which is a member to be opened and closed every day when the automatic developing apparatus A is used. Therefore, it is possible to prevent the solid processing agent J from sticking to each other or other members. In this way, the occurrence of inappropriate conveyance of the solid processing agent can be prevented.

In the case of moving the processing agent supply section 37, there is provided a cover 38 which covers a disconnected portion on the fixed side. This cover automatically closes an opening of the supply passage 27 when the processing agent supply section 37 is moved. When the cover 38 is provided which covers a disconnected portion on the fixed side, the processing solution is not mixed with other solutions, so that contamination can be prevented.

Incidentally, as described before in the explanation relating to FIG. 3, a skylight 303 is pivotally linked on a part of an upper surface of the first cover 902, although the skylight 303 is not shown in FIG. 9. When the skylight 303 is opened, the setting or replacing of the accommodation container 33 can be conducted.

FIGS. 10 to 13(*e*) show still another example in which the automatic developing apparatus A is provided with a plurality of processing agent supply sections 37 capable of moving simultaneously when operation is performed only once. In the same manner as that of the example shown in FIG. 9, in the automatic developing apparatus A shown in FIG. 10, a plurality of processing agent supply sections 37 are provided on the cover 902. However, the cover 902 is opened and closed with respect to the main body 101 along a plane parallel with the conveyance direction of the photosensitive material. Therefore, the processing agent supply section 37 is moved in a different direction from that of the example described before. The rotational fulcrum of this cover 902 may be provided on either the upstream or downstream side with respect to the conveyance direction of the photosensitive material. However, it is preferable that the rotational fulcrum of the cover 902 is provided on the downstream side, because the processing agent supply section 37 for supplying the solid processing agent J to another processing tank does not pass through an upper portion of the opening of the dissolving section 2 communicated with the developing tank.

Figure 11:
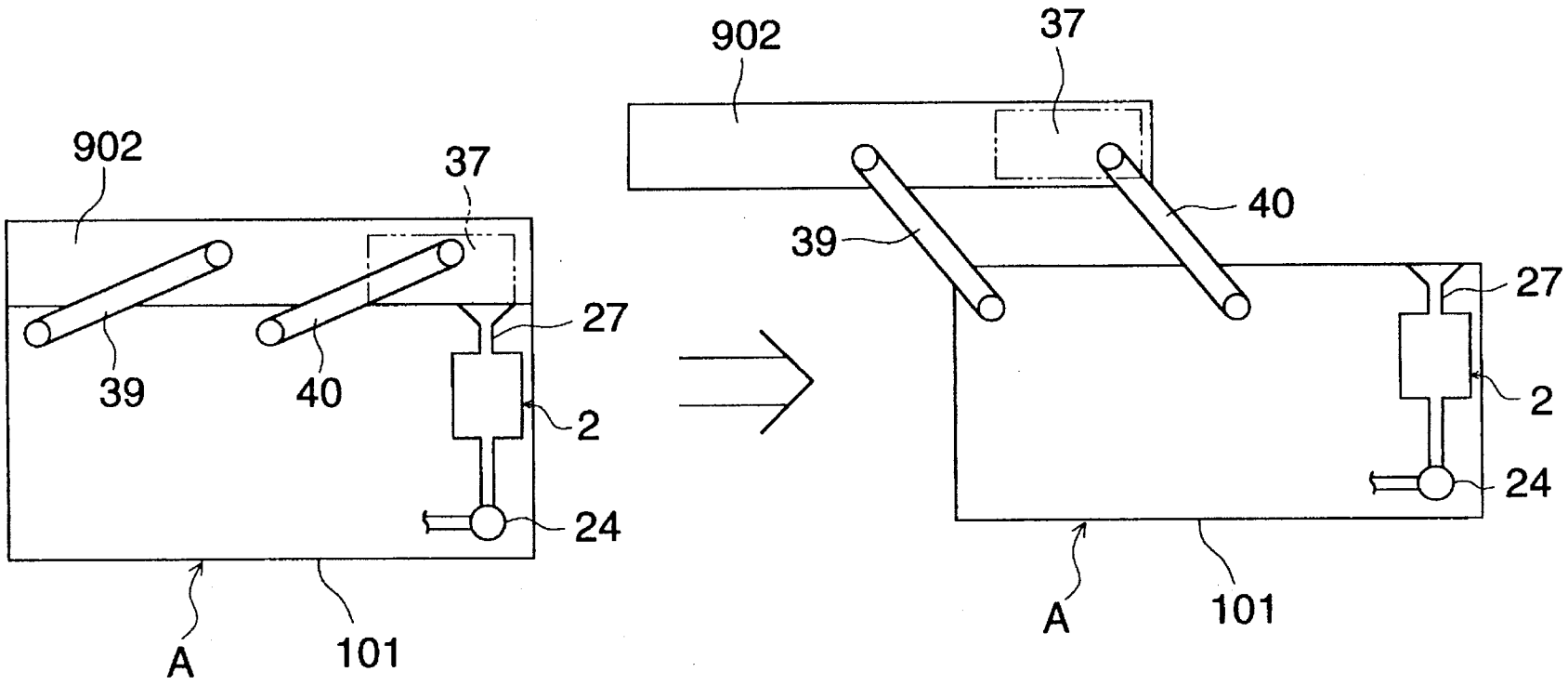
FIG. 11 is a view showing still another example in which a plurality of processing agent supply sections are provided in accordance with the processing tanks of the automatic developing apparatus.

In the same manner as that of the example shown in FIG. 9, in the automatic developing apparatus A shown in FIG. 11, a plurality of processing agent supply sections 37 are provided on the cover 902. The cover 902 is opened and closed with respect to the main body 101 along a plane perpendicular to the conveyance direction of the photosensitive material. The cover 902 is supported by pairs of arms 39, 40 provided on both sides of the main body 101. When the arms 39, 40 are rotated, the cover 902 is moved in parallel, so that the processing agent supply section 37 can be moved. In this case, the cover 902 is moved on a plane perpendicular to the conveyance direction of the photosensitive material, however, the cover 902 may be moved on a plane parallel with the conveyance direction of the photosensitive material.

Figure 12:
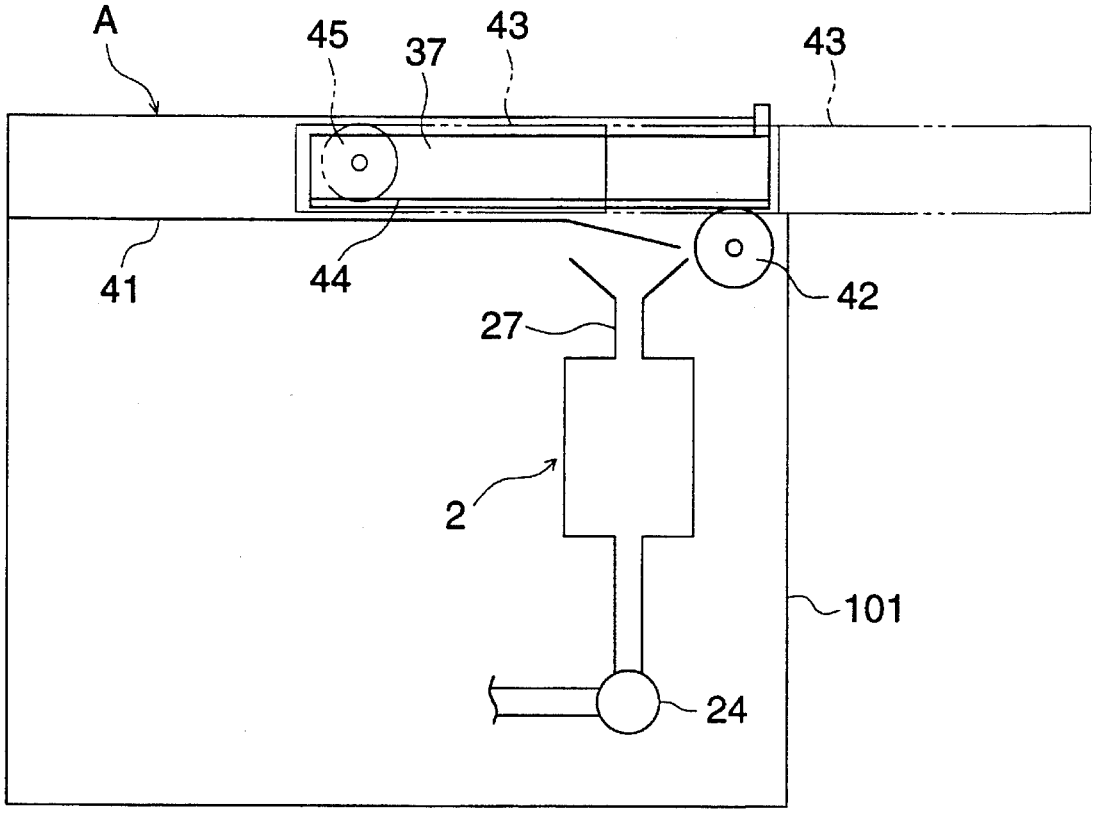
FIG. 12 is a view showing still another example in which a plurality of processing agent supply sections are provided in accordance with the processing tanks of the automatic developing apparatus.

The automatic developing apparatus A shown in FIG. 12 is composed as follows: The rail 41 and roller 42 are provided in the main body 101. Also, the rail 44 and roller 45 are provided in the unit 43 of a plurality of processing agent supply sections 37. Therefore, the unit 43 of the plurality of processing agent supply sections 37 is capable of sliding in parallel. In this way, the unit 43 of the plurality of processing agent supply sections 37 is pulled out from the main body 101. In this example, the unit 43 of the plurality of processing agent supply sections 37 is moved on a plane perpendicular to the conveyance direction of the photosensitive material, however, it may be moved on a plane parallel with the conveyance direction of the photosensitive material.

Figure 13:
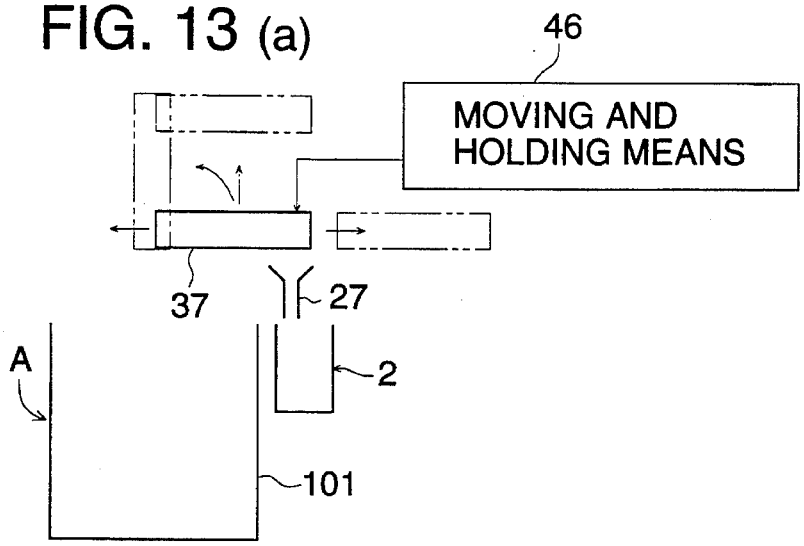
FIGS. 13(*a*) through 13(*e*) are views showing still another example in which a plurality of processing agent supply sections are provided in accordance with the processing tanks of the automatic developing apparatus.
Figure 13:
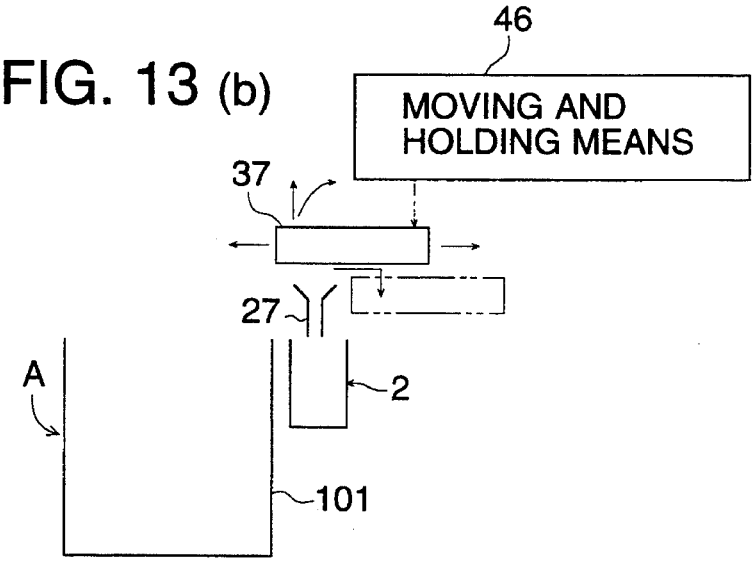
Figure 13:
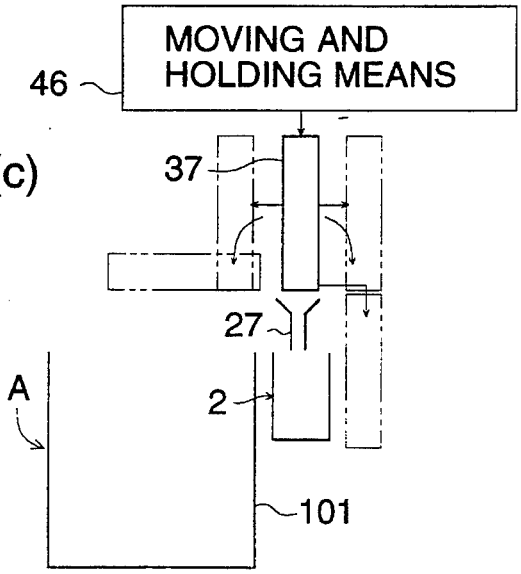
Figure 13:
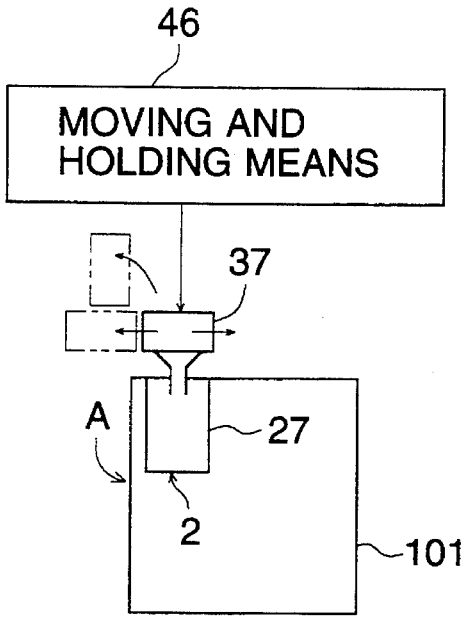
Figure 13:
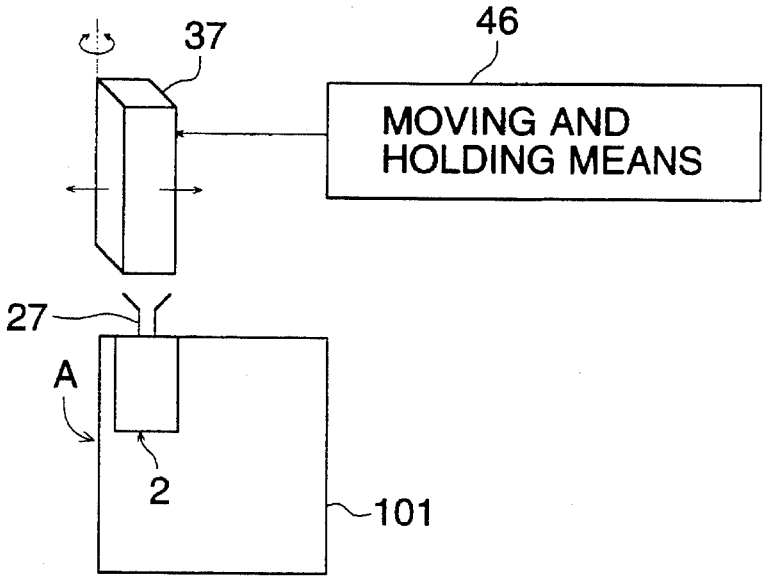

FIGS. 13(*a*) to 13(*e*) are views showing examples of the automatic developing apparatus A in which the processing agent supply section 37 is provided in accordance with the processing tank. In these examples, the processing agent supply section 37 is not necessarily provided on the cover of the main body 101, and the independent processing agent supply section 37 is moved in the arrowed direction from an initial position indicated by the solid line in the drawing. That is, the processing agent supply section 37 is released from the dissolving section and moved by the moving and holding means 46, and this moved processing agent supply section 37 is held at a predetermined position. In the apparatus shown in FIGS. 13(*a*) to 13(*c*), the movement direction of the processing agent supply section 37 is not limited to a specific direction. However, in the apparatus shown in FIGS. 13(*d*) and 13(*e*), the processing agent supply section 37 is capable of moving on a plane parallel with the conveyance direction of the photosensitive material.

As explained above, according to the present invention, it is possible to release the processing agent supply section from the dissolving section so that the processing agent supply section can be moved. Since the processing agent supply section is moved, the apparatus can be easily maintained, and it is possible to prevent the occurrence of corrosion and electric leakage.

Accordingly, for example, when the processing agent supply section is daily moved in the case of stoppage of operation, dew condensation can be prevented and the occurrence of corrosion and electric leakage can be also prevented. Further, the solid processing agent can be prevented from absorbing the moisture, so that the solid processing agent is not denatured. Furthermore, it is possible to prevent the solid processing agent from expanding or sticking to each other or other elements. In this way, the occurrence of inappropriate conveyance of the solid processing agent can be prevented.

According to the present invention, when the processing agent supply section is moved, the processing agent is not deposited on the processing agent supply section, so that the processing solution is not mixed with other solutions, and the occurrence of contamination can be prevented.

According to the present invention, the processing agent supply section is moved by the opening and closing means. According to the present invention, a plurality of processing agent supply sections are simultaneously and easily moved.

What is claimed is:

1. An apparatus for processing a silver halide photographic material with a processing solution, comprising:

a processing tank in which the processing solution is stored;

a dissolving section for dissolving a solid processing agent, the dissolving section communicated with the processing tank so that the processing solution is circulated between the processing tank and the dissolving section;

an accommodation member in which the solid processing agent is stored;

a supply member having an inlet opening with which the accommodation member is detachably connected and an outlet opening so that the supply member receives the solid processing agent through the inlet opening and discharges the solid processing agent through the outlet opening; and a processing agent supply section in which the accommodation member and the supply member are constructed in a single body, the processing agent supply section movable together with the accommodation member and the supply member between a first position and a second position, wherein the supply member is connected with the dissolving section in the first position so that the solid processing agent is supplied from the outlet opening of the supply member into the dissolving section, and the supply member is disconnected from the dissolving section in the second position so that the outlet opening of the supply member is isolated from the dissolving section.

2. The apparatus of claim 1, wherein the dissolving section has an opening through which the processing agent is supplied into the dissolving section, and wherein on the first position the processing agent supply section locates above the opening and on the second position the processing agent supply section is moved away from the opening.

3. The apparatus of claim 1, wherein the silver halide photographic material is conveyed in the processing tank in a conveying direction and the processing agent supply section is moved in a direction perpendicular to the conveying direction of the silver halide photographic material.

4. The apparatus of claim 1, wherein the dissolving section provided with a supply passage member forming a passage through which the processing agent is supplied into the dissolving section.

5. The apparatus of claim 4, wherein the connection and disconnection of the processing agent supply section is made between the supply member and the supply passage member.

6. The apparatus of claim 1, further comprising a setting member to move the processing agent supply section between the first position and the second position and to hold the processing agent supply section at the second position.

7. The apparatus of claim 1, wherein the dissolving section is provided in the processing tank.

8. The apparatus of claim 1, wherein the apparatus comprises a developing division and another process division and each division comprises the processing tank and the processing agent supply section.

9. The apparatus of claim 8, wherein the dissolving section of each division has an opening through which the processing agent is supplied into the dissolving section, and wherein the processing agent supply section of the another process division is arranged not to pass over the processing tank of the developing division and the opening of dissolving section of the developing division when the processing agent supply section of the another process division is moved.

10. The apparatus of claim 1, wherein the processing tank has an open top and an open/close member movable on a periphery of the open top of the processing tank, and wherein the processing agent supply section is provided on the open/close member so that the processing agent supply section is moved together with the open/close member.

11. An apparatus for processing a silver halide photographic material with a processing solution, comprising:

(a) a processing tank in which the processing solution is stored, (b) a dissolving section for dissolving a solid processing agent, the dissolving section communicated with the processing tank so that the processing solution is circulated between the processing tank and the dissolving section; and (c) a processing agent supply section movable between a first position and a second position, wherein the processing agent supply section is brought in connection with the dissolving section in the first position, and the processing agent supply section is disconnected from the dissolving section in the second position, the processing agent supply section including an accommodation member in which the solid processing agent is stored, and a supply member to supply the solid processing agent into the dissolving section in the first position of the processing agent supply section; and wherein the dissolving section is provided with a supply passage member forming a passage through which the processing agent is supplied into the dissolving section, and the supply passage member is provided with a lid so that the passage formed by the supply passage member is blocked with the lid when the processing agent supply section is disconnected in the second position.

12. An apparatus for processing a silver halide photographic material with a processing solution, comprising:

(a) a processing tank in which the processing solution is stored;

(b) a dissolving section for dissolving a solid processing agent, the dissolving section communicated with the processing tank so that the processing solution is circulated between the processing tank and the dissolving section;

(c) a processing agent supply section movable between a first position and a second position, wherein the processing agent supply section is brought in connection with the dissolving section in the first position, and the processing agent supply section is disconnected from the dissolving section in the second position, the processing agent supply section including an accommodation member in which the solid processing agent is stored, and a supply member to supply the solid processing agent into the dissolving section in the first position of the processing agent supply section; and (d) a housing having an open top and a open/close member movable on a periphery of the open top of the housing, wherein the processing tank is provided in the housing and the processing agent supply section is provided on the open/close member so that the processing agent supply section is moved together with the open/close member.

13. The apparatus of claim 12, wherein the open/close member is a pivotal cover.

14. An apparatus for processing a silver halide photographic material with a processing solution, comprising:

(a) a processing tank in which the processing solution is stored;

(b) a dissolving section for dissolving a solid processing agent, the dissolving section communicated with the processing tank so that the processing solution is circulated between the processing tank and the dissolving section;

(c) a processing agent supply section movable between a first position and a second position, wherein the processing agent supply section is brought in connection with the dissolving section in the first position, and the processing agent supply section is disconnected from the dissolving section in the second position, the processing agent supply section including an accommodation member in which the solid processing agent is stored, and a supply member to supply the solid processing agent into the dissolving section in the first position of the processing agent supply section; and (d) a developing division and another process division, each division comprising the processing tank and the processing agent supply section; and wherein the plural processing agent supply sections of the developing division and the another process division are linked mutually so that the plural processing agent supply sections are moved simultaneously between the first position and the second position.

15. An apparatus for processing a silver halide photographic material with a processing solution, comprising:

(a) a processing tank in which the processing solution is stored;

(b) a dissolving section for dissolving a solid processing agent, the dissolving section communicated with the processing tank so that the processing solution is circulated between the processing tank and the dissolving section;

(c) a processing agent supply section movable between a first position and a second position, wherein the processing agent supply section is brought in connection with the dissolving section in the first position, and the processing agent supply section is disconnected from the dissolving section in the second position, the processing agent supply section including an accommodation member in which the solid processing agent is stored, and a supply member to supply the solid processing agent into the dissolving section in the first position of the processing agent supply section;

(d) a developing division and another process division, each division comprising the processing tank and the processing agent supply section; and (e) a housing having an open top and a open/close member movable on a periphery of the open top of the housing, wherein the plural processing tanks are provided in the housing and the plural processing agent supply sections are provided on the open/close member.

16. The apparatus of claim 15, wherein the open/close member is a pivotal cover.

* * * * *